US006276290B1

(12) United States Patent
Yamada et al.

(10) Patent No.: US 6,276,290 B1
(45) Date of Patent: Aug. 21, 2001

(54) SMALL WATERCRAFT HAVING AN IMPROVED STRUCTURE OF STORAGE COMPARTMENT

(75) Inventors: Hisato Yamada; Kenichi Otsuka, both of Iwata (JP)

(73) Assignee: Yamaha Hatsudoki Kabushiki, Iwata (JP)

( * ) Notice: Subject to any disclaimer, the term of this patent is extended or adjusted under 35 U.S.C. 154(b) by 0 days.

(21) Appl. No.: 09/046,806

(22) Filed: Mar. 23, 1998

(30) Foreign Application Priority Data

Mar. 21, 1997 (JP) ..... 9-087673

(51) Int. Cl.[7] ..... B63B 17/00
(52) U.S. Cl. ..... 114/55.51; 114/55.53
(58) Field of Search ..... 114/55.5, 55.51, 114/55.52, 55.53, 55.54, 55.55, 55.57, 343, 364

(56) References Cited

U.S. PATENT DOCUMENTS 4,909,176 * 3/1990 Kobayashi ..... 114/55.53
5,390,621 2/1995 Hattori et al. .
5,438,946 8/1995 Kobayashi .
5,511,505 * 4/1996 Kobayashi et al. ..... 114/55.5
5,607,332 * 3/1997 Kobayashi et al. ..... 114/55.57
5,634,422 6/1997 Kobayashi et al. ..... 114/363
5,664,515 * 9/1997 Hattori et al. ..... 114/211
5,669,326 9/1997 Ikeda .
5,676,086 10/1997 Watkins .
5,957,072 * 9/1999 Harrori ..... 114/55.57

* cited by examiner

*Primary Examiner*—Sherman Basinger
(74) *Attorney, Agent, or Firm*—Knobbe, Martens, Olson, & Bear, LLP

(57) ABSTRACT

A small watercraft includes expanded storage capacity so as to accommodate more of the type of articles that rider's typically what to carry on the watercraft. Such articles include, for example, towels, water skis, tow ropes, etc. One of the storage compartments on the watercraft may be formed by an opening on an upper deck section. A container is affixed to the deck below the opening and has an upper end defined by a flange that extends from walls of the container. The flange is attached to an interior wall of the upper deck section so that the container and the corresponding upper deck section form a storage compartment. The upper end opening of the container, however, has a larger area than the opening in the deck so as to maximize the storage space within the compartment without weakening the deck, and at the same time to minimize the area through which water can enter the hull.

75 Claims, 16 Drawing Sheets

SMALL WATERCRAFT HAVING AN IMPROVED STRUCTURE OF STORAGE COMPARTMENT

BACKGROUND OF THE INVENTION

1. Field of the Invention

The present invention generally relates to small watercraft. More particularly, the present invention relates to a structure and an arrangement of storage compartments within a hull of a small watercraft.

2. Description of Related Art

Personal watercraft have become increasingly popular in recent years. This type of watercraft commonly includes a small hull which mainly comprises a lower hull section and an upper deck section. These small watercraft generally have at least one storage compartment within the hull.

The storage compartment is generally a container arranged to lie within the hull of the watercraft. The container commonly has sidewalls and an open top surrounded by a flange. The flange extends from the side walls of the container. The upper deck section of the hull has an opening with a circumferential member. The container is inserted into the opening such that the flange of the container rests atop on the circumferential member of the opening. The container is thus removably supported by the upper deck, and a compartment is defined within the hull below the deck. A lid or hatch is provided to cover the opening of the container. The lid inhibits an influx of water into both the hull and the container. Because the container is removable, the opening on the upper deck section can also be used as an access way into the interior of the hull when internal components of the watercraft require servicing.

In prior personal watercraft, the storage compartment thus is simply a container inserted into the opening. The size of the container therefore is limited by the size of the opening formed in the upper deck section. Riders of personal watercraft, however, continue to desire more storage area as these watercraft are being used in more diverse ways. A need therefore exists to provide more storage area on the watercraft.

SUMMARY OF THE INVENTION

The present watercraft design provides for enlarged storage capacity without increasing the overall hull design or weakening the hull's strength. It is appreciated that an enlarged opening in the watercraft bow may reduce the strength of the hull. However, because the front end of the watercraft generally slopes upward on the upper deck section and downward on the lower hull section, unused space usually exists within the interior of the bow. The present watercraft design therefore takes advantage of this space, or other space in the hull, to enlarge the storage compartment space of the watercraft, without weakening the strength of the hull.

In one mode, the small watercraft comprises a hull including a lower hull portion and an upper deck. The upper deck has a bow portion and a rider's area positioned on an aft side of the bow portion. A raised pedestal is provided on the hull in the rider's area and a seat assembly is supported by the raised pedestal. The seat assembly includes a seat that is configured to accommodate at least one rider. A container is affixed to the upper deck and has an upper inner perimeter edge. An access opening is formed in the upper deck and opens into the container. A hatch is movably coupled to the upper deck so as to be moved between closed and open positions. In the closed position, the hatch covers the opening. In the opening position, the hatch permits access into the compartment through the opening. The opening has a smaller area than the area defined by the upper inner perimeter edge of the container so as to inhibit the intake of water into the container while providing a larger storage space than that which would correspond to the footprint of the accessing opening. This also is done without weakening the deck portion.

Another aspect of the present invention involves a small watercraft comprising a hull including a lower hull portion and an upper deck. An inner hull space is defined between the lower hull portion and the upper deck, and at least part of the inner hull space defines an engine compartment. The upper deck includes a bow portion and a rider's area position on an aft side of the bow portion. A raised pedestal is provided on the hull in the rider's area and supports a seat assembly that is configured to accommodate at least one rider. A pair of raised bulwarks extend along opposite sides of at least a portion of the raised pedestal. A pair of foot surfaces are also provided with each surface extending between the raised pedestal and one of the raised bulwarks such that foot step areas are defined on the opposite sides of the raised pedestal. A storage compartment is also defined within the inner hull space. In one mode, the watercraft also includes a hatch that covers an access opening to the storage compartment. The hatch is hinged on its outer side, which is generally on a side of the hatch opposite of a longitudinal center line of the watercraft.

These and other features of the present invention will become more fully apparent from the following description and claims.

BRIEF DESCRIPTION OF THE DRAWINGS

These and other features of the invention will now be described with reference to the drawings of a preferred embodiment which is intended to illustrate and not to limit the invention, ad in which.

DETAILED DESCRIPTION OF PREFERRED EMBODIMENTS

Figure 1:
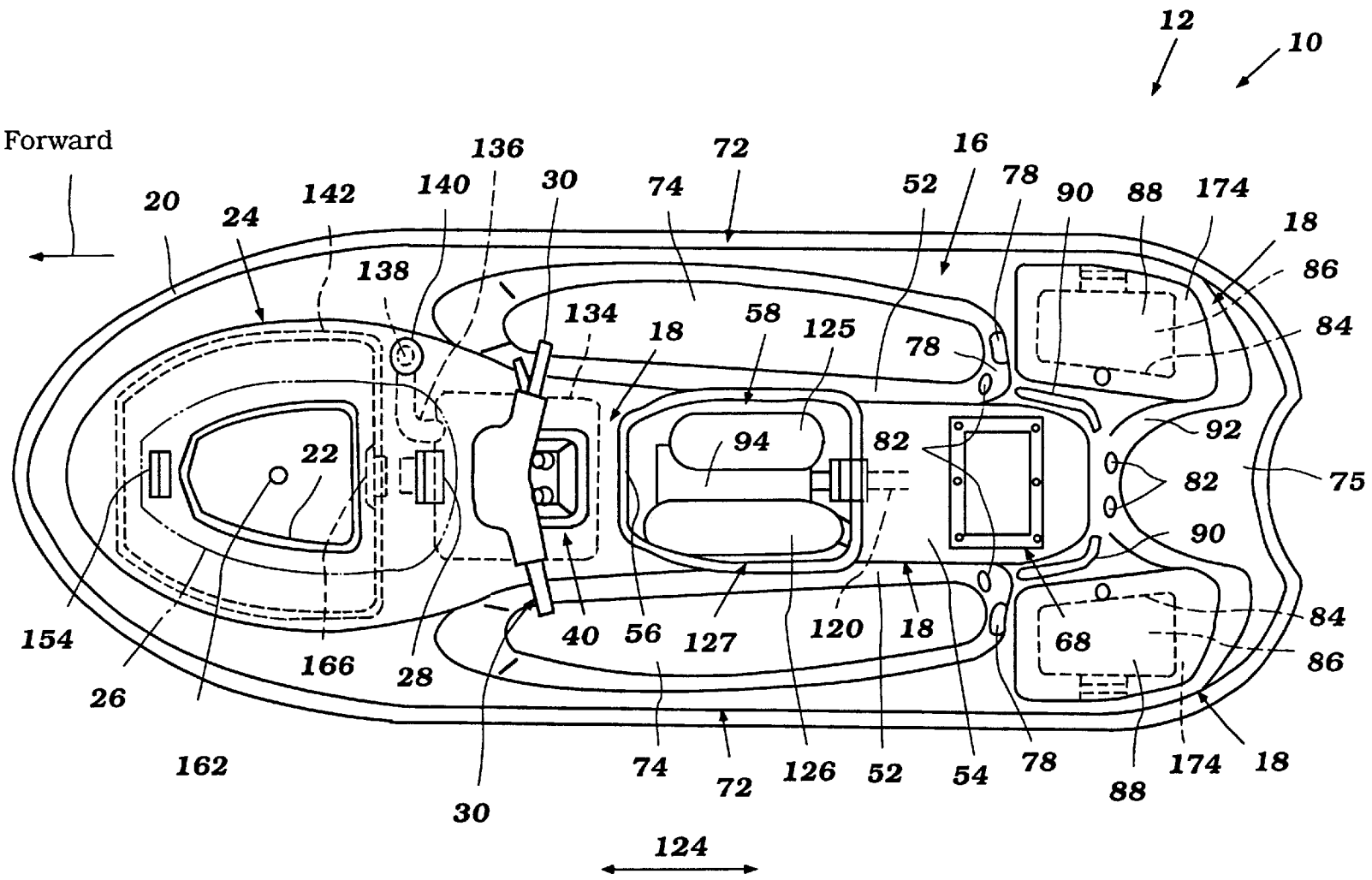
FIG. 1 is a top plan view of a personal watercraft configured in accordance with a preferred embodiment of the present invention, illustrating several internal components in phantom.

Although the present invention is illustrated in connection with a personal watercraft, it is understood that the present storage compartment structure and arrangement can be used with other types of watercraft as well. For example, but without limitation, the present storage compartment structure and arrangement can also be used with small jet boats and the like.

FIGS. 1–8 illustrate a personal watercraft 10 having several storage compartments in accordance with a preferred embodiment of the present invention. In general, the watercraft 10 has a bow and a stem. In addition, the watercraft 10 includes a watercraft body 12 comprising a hull 14. The hull 14 of the watercraft 10 is formed by a lower hull section 16 and an upper deck section 18. The hull sections 16, 18 are formed from a suitable material such as, for example, a molded fiberglass reinforced resin. The lower hull section 16 and the upper deck section 18 are fixed to each other around the gunnel 20 in any suitable manner.

As viewed in the direction from the bow to the stern of the watercraft 10, the upper deck section 18 includes a bow portion, a control portion, and a rider's area. The bow portion slopes upwardly toward the control portion and includes an opening 22. The opening 22 is provides access to a front storage compartment 24 formed underneath the bow portion of the upper deck section 18. The structure and arrangement of the front storage compartment 24 will be described in greater detail below. A hatch or lid 26 covers the opening 22 to inhibit an influx of water into the hull 14 and the front storage compartment 24, and also slopes upwardly to the control portion.

The control portion extends upward from the bow portion and includes a display or meter 28 and a handlebar assembly 30. The handlebar 30 controls the steering of the watercraft 10 in a conventional manner. The handlebar assembly 30 also carries a variety of controls watercraft controls, such as, for example, a throttle control, a start switch and a lanyard switch.

An opening 32 is formed on the upper deck section 18 between the control portion and the rider's area. A container 34 having an open top 36 surrounded by a flange 38 is inserted into the opening 32 to form a storage compartment 40. The storage compartment is sized to store small articles A, such as keys, wallets, etc. A cover 42 is provided to close the container 34 and may be connected to the flange 38 of the container 34 with a hinge 44. The storage compartment 40 may alternatively be implemented in a manner described in detail below.

The rider's area lies behind the control portion and includes a seat assembly 46. In the illustrated embodiment, the seat assembly 46 has a longitudinally extending straddle-type shape which may be straddled by an operator and by at least one or two passengers. The seat assembly 46, at least in principal part, is formed by a front seat cushion 48 and a rear seat cushion 50. The seat assembly 46 is supported by a raised pedestal 52. The raised pedestal 52 forms a portion of the upper deck section 18, and has an elongated shape that extends longitudinally along a central portion of the watercraft 10. Advantageously, the front and rear seat cushions 48, 50 are removably mounted on an upper surface 54 of the pedestal 52 and cover at least a substantial portion of an upper end of the pedestal 52 for the comfort of the rider and passenger.

An access opening 56 is located on an upper surface 54 of the pedestal 52. The access opening 56 opens into an engine compartment 58 formed within the hull 14. The front seat cushion 48 normally covers and seals the access opening 56. When the front seat cushion 48 is removed, the engine compartment 58 is accessible through the access opening 56. A pump compartment 59 is located behind the engine compartment 58.

The upper surface 54 of the pedestal 52 extends rearward to the upper deck section 18. Another opening 60 is located on the upper deck section 18 behind the access opening 56 for the engine compartment 58. A container 62 having an open top 64 defined by a flange 66 is inserted into the opening 60 to form a storage compartment 68 similar to the compartment 40 between the control portion and the rider's area. A pair of longitudinal grooves 70 are provided along both sides of the opening 60 for removably receiving the rear seat cushion 50. The rear seat cushion 50 covers and seals the open top 64 of the container 62. The storage compartment is sized to receive through its upper end 69 relatively small articles A, such as, for example, cans of beverages, bait, etc. The storage compartment 68 may alternatively be implemented in a manner described in detail below.

Figure 6:
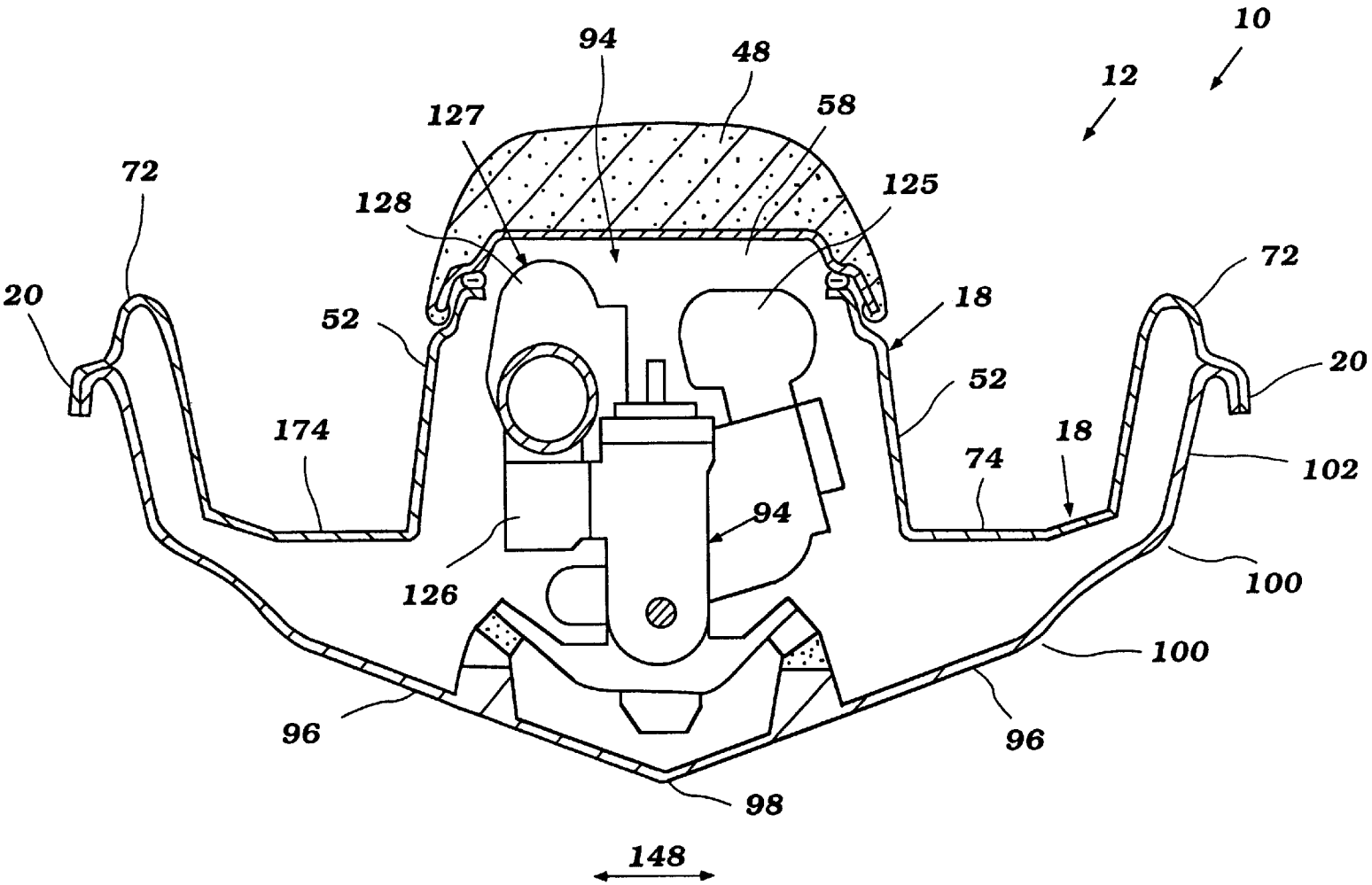
FIG. 6 is a cross-sectional view of the watercraft taken along line 6—6 of FIG. 3.

As best seen in FIG. 6, the upper deck section 18 of the hull 14 advantageously includes a pair of raised bulwarks 72 positioned on opposite sides of the aft end of the upper deck section 18. The raised bulwarks 72 define a pair of foot step areas 74 that extend generally longitudinally and parallel to the sides of the pedestal 52. The operator and any passengers sitting on the seat assembly 46 can thus place their feet in the foot step areas 74 with the raised bulwarks 72 shielding the feet and lower legs of the riders. A non-slip mat (not shown) made of, for example, rubber or a synthetic material, desirably covers the foot step areas 74 to provide increased grip and traction for the operator and the passengers.

Figure 3:
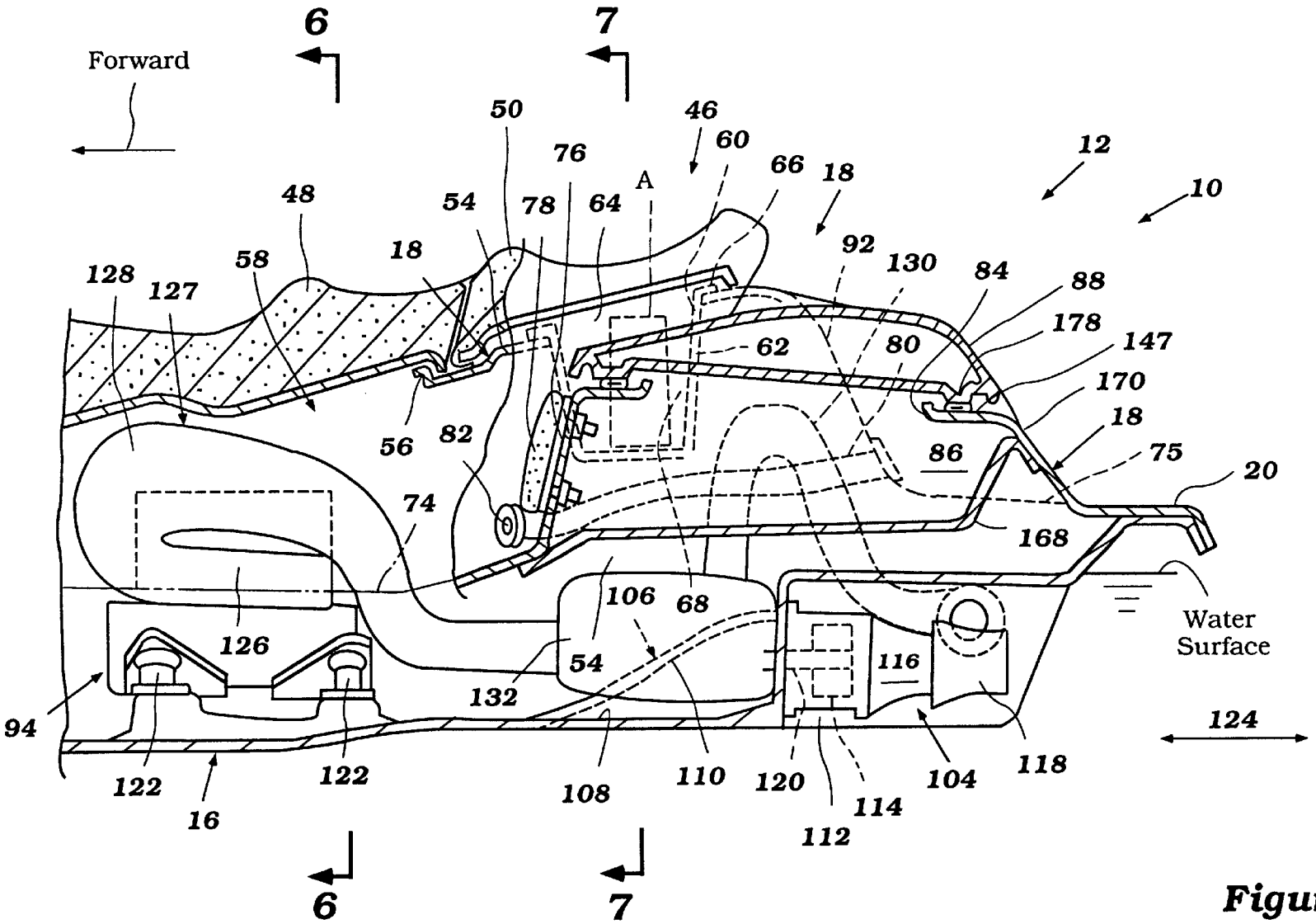
FIG. 3 is a partial side cross-sectional view of a rear portion of the watercraft of FIG. 1.

With reference to FIG. 3, the rear portion of the foot step areas 74 end by a pair steeply slanted walls 76 which form a portion of the upper deck section 18 at about the center of the rear seat cushion 50. As shown in FIG. 3, a cushion pad 78 configured to support a lower leg of a passenger is attached to each of the slanted walls 76.

A drain tube 80 extends from a hole or an inlet 82 on the bottom of the slant wall 76. The drain tube 80 connects the foot step area 74 to a deck area 75 on the hull 14 of the watercraft 10 behind the seat assembly.

The upper deck section 18 extends horizontally from the top of the slant wall 76 and includes two further openings 84 at both sides of the rear seat cushion 50. The openings 84 provide access to a rear storage compartment 86 arranged underneath the upper deck section 18. The structure and arrangement of the rear storage compartment 86 will be described in greater detail below. A lid or cover 88 closes the opening 84 to inhibit an influx of water into the hull 14 and the rear storage compartment 86. Two bars 90 are arranged between the rear seat cushion 50 and the covers. The bars 90 provide a grasping location for passengers.

A slant wall 92 behind the rear seat cushion 50 has a pair of drain tube holes 82 on the bottom. As mentioned above, the drain tubes extend rearwardly from inlets arranged within the foot step areas 74. The upper deck section 18 terminates at the riding floor 75 which extends rearward of the slant wall 92. The drainage tube holes 82 are positioned higher than the inlets when a keel line of the watercraft is level; however, when the watercraft is up on plane, the inlets lie above the drainage tube holes 82 to allow water to flow from the foot wells to deck area 75 of the watercraft.

The engine compartment 58 is defined within a central portion of the hull. The engine compartment 58 is normally substantially sealed so as to enclose an engine 94 of the watercraft 10. Enclosing the engine 94 serves to protect the engine from splashing created when maneuvering the watercraft 10.

Figure 4:
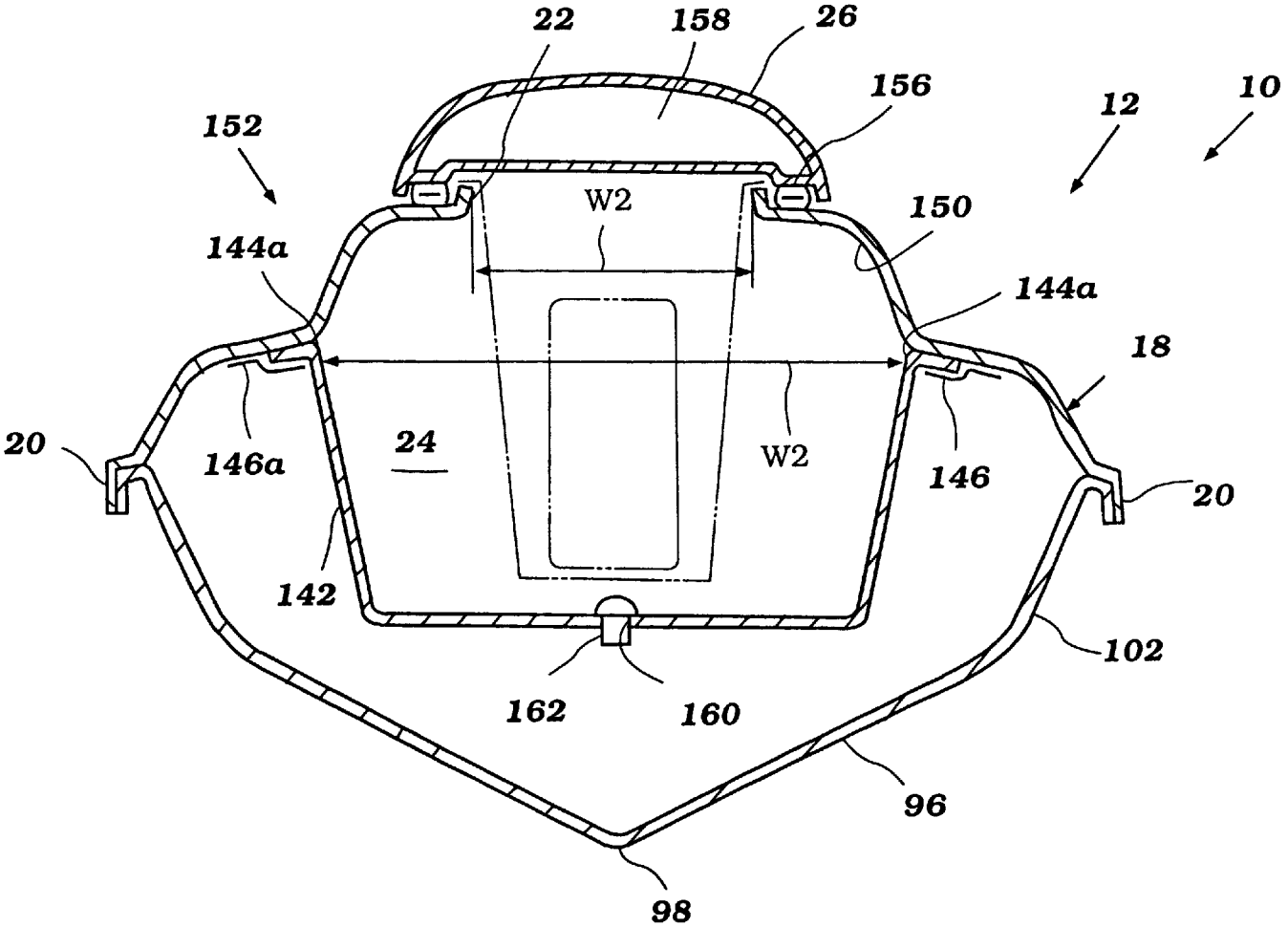
FIG. 4 is a cross-sectional view of the watercraft taken along line 4—4 of FIG. 2, illustrating a front storage compartment.
Figure 5:
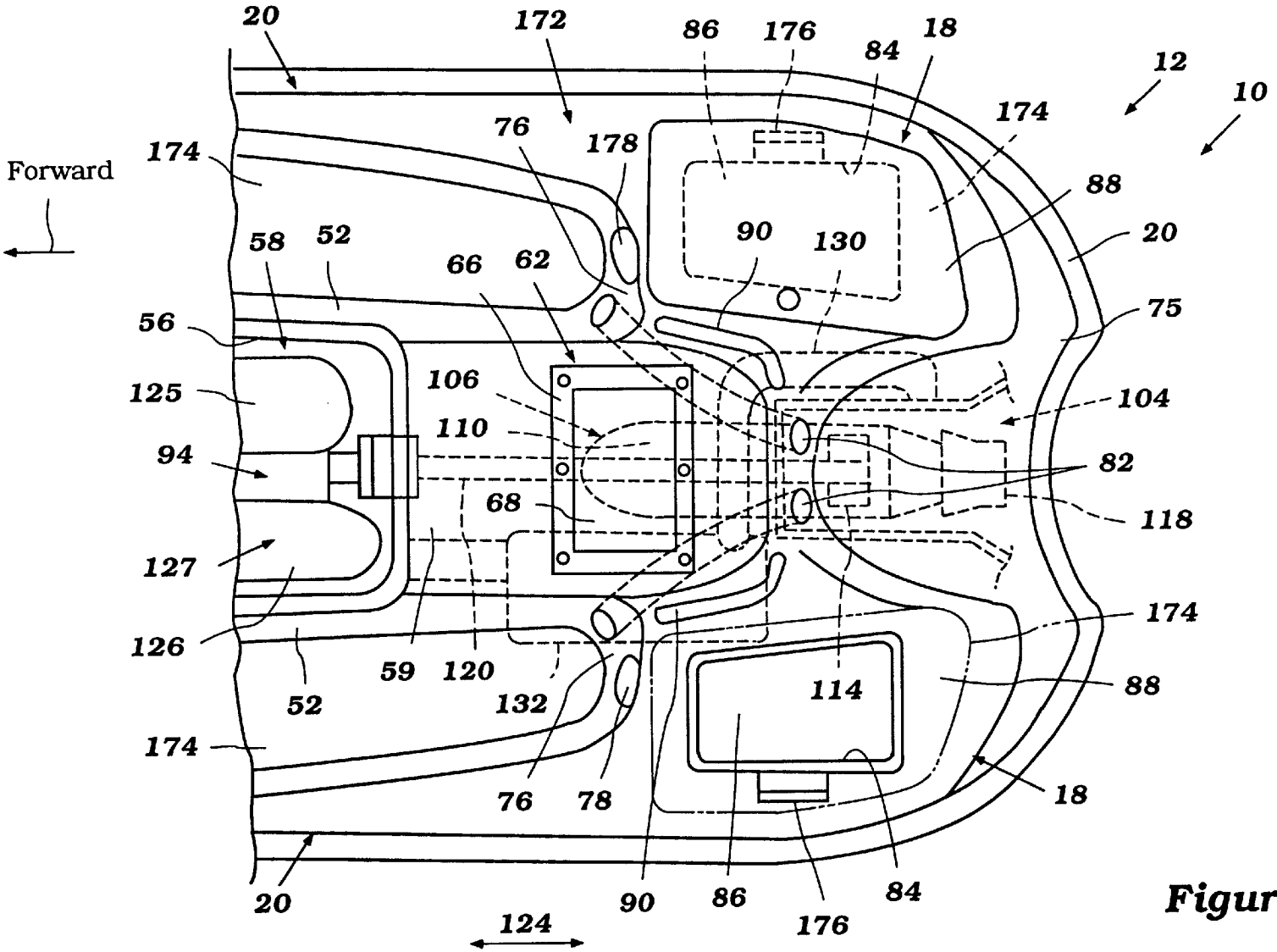
FIG. 5 is an enlarged top plan view of the rear portion of the watercraft.
Figure 7:
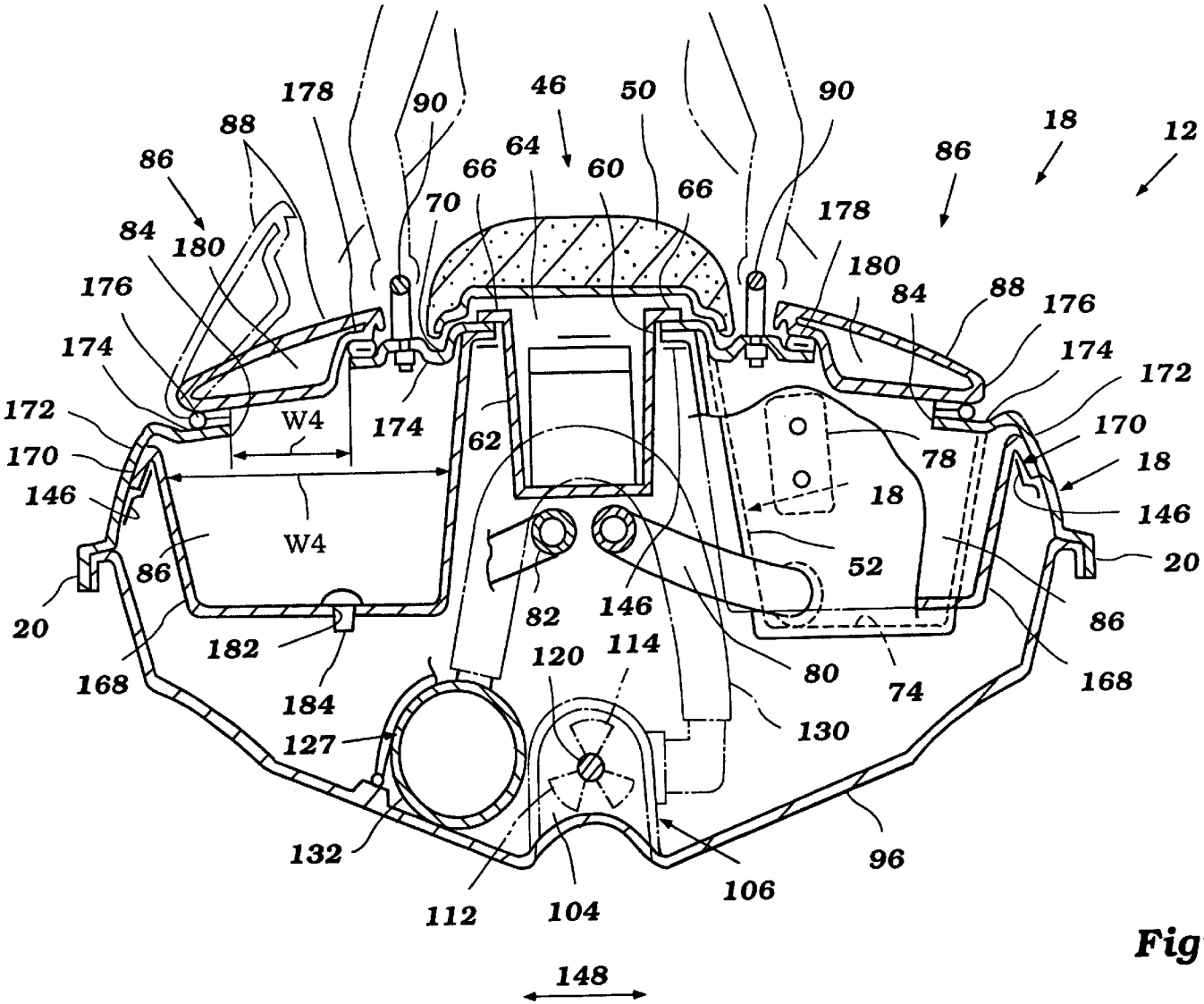
FIG. 7 is a cross-sectional view of the watercraft taken along line 7—7 of FIG. 3, illustrating a pair of rear storage compartments.

The lower hull section 16 is designed such that the watercraft 10 planes or rides on a minimum surface area of the aft end of the lower hull section 16 in order to optimize the speed and handling of the watercraft 10 when up on plane. For this purpose, as shown in FIGS. 4 and 7, the lower hull section 16 generally has a V-shaped configuration formed by a pair of inclined sections 96 that extend outwardly from the keel line 98 to outer chines 100 at a dead rise angle. The inclined sections extend longitudinally from the bow toward the transom of the lower hull 16 and extend outwardly to side walls 102 of the lower hull 16.

The side walls 102 are substantially upstanding near the stern of the lower hull 16 and smoothly blend towards the longitudinal center of the watercraft 10 near the bow. The lines of intersection between the inclined section 96 and the corresponding side wall 102 form the outer chines 100 of the lower hull section 16. The lower hull 16 can also include additional chines between the keel line and the outer chines 100 for improved handling, as is known in the art.

In the illustrated embodiment, a jet pump unit 104 propels the watercraft 10. The jet pump unit 104 is mounted within a tunnel of the lower hull section 16 in a known manner. An intake duct 106 of the jet pump unit 104 defines an inlet opening 108 and a gullet or channel 110. The gullet 110 leads to an impeller housing 112 in which an impeller 114 of the jet pump operates. A portion of the impeller housing 112 defines a pressurization chamber and delivers a pressurized water flow to a discharge nozzle 116.

A steering nozzle 118 is supported at a downstream end of the discharge nozzle 116 by a pair of vertically extending pivot pins (not shown). In an exemplary embodiment, the steering nozzle 118 has an integral lever on one side that is coupled to the handlebar 30 assembly through, for example, a bowden-wire actuator, as known in the art. In this manner, the operator of the watercraft 10 can effect directional changes of the watercraft 10 through selectively directing the steering nozzle 118.

A ride plate (not shown) covers a portion of the gullet or channel 110 behind the inlet opening 108 to substantially enclose the jet pump unit 104. In this manner, the inlet opening 108 is closed to provide a planing surface for the watercraft 10.

An impeller shaft 120 drives the impeller 114 within the impeller housing 112. The aft end of the impeller shaft 120 is suitably journalled for rotation within the compression chamber of the housing in a known manner. The impeller shaft 120 extends in the forward direction and is coupled to an output shaft of the engine 94.

The engine 94 powers the impeller shaft 120. The engine 94 is positioned within the engine compartment 58 and is mounted primarily beneath the front seat cushion 48. Vibration absorbing engine mounts 122 secure the engine 94 to the lower hull 16. The engine 94 is desirably mounted in approximately a central portion of the watercraft 10.

The engine 94 advantageously includes a plurality of in-line cylinders and operates on a four-cycle principle; however, it this type of engine is merely exemplary. The present watercraft can employ other type of engine configurations and operate on other principles (e.g. two cycle, crankcase compression) as well. The engine 94 is positioned such that the row of cylinders lies parallel to a longitudinal axis 124 of the watercraft 10, running bow to stem. Although not illustrated, the engine 94 and associated systems or components (such as an induction system 125, a fuel supply system, an exhaust manifold 126, etc.) interconnect with one another within the engine compartment 58.

In the illustrated embodiment, exhaust gas from the engine 94 are discharged to the water near the steering nozzle 118 through an exhaust system 127. The exhaust system 127 includes the exhaust manifold 126, which is connected to the engine 94, and an expansion chamber 128 which communicates and receives exhaust gases from the exhaust manifold 126. A suitable opening loop cooling system may cool the exhaust manifold and the expansion chamber, as known in the art. The jet pump unit 104 can supply cooling water to the cooling system in a conventional manner.

Figure 8:
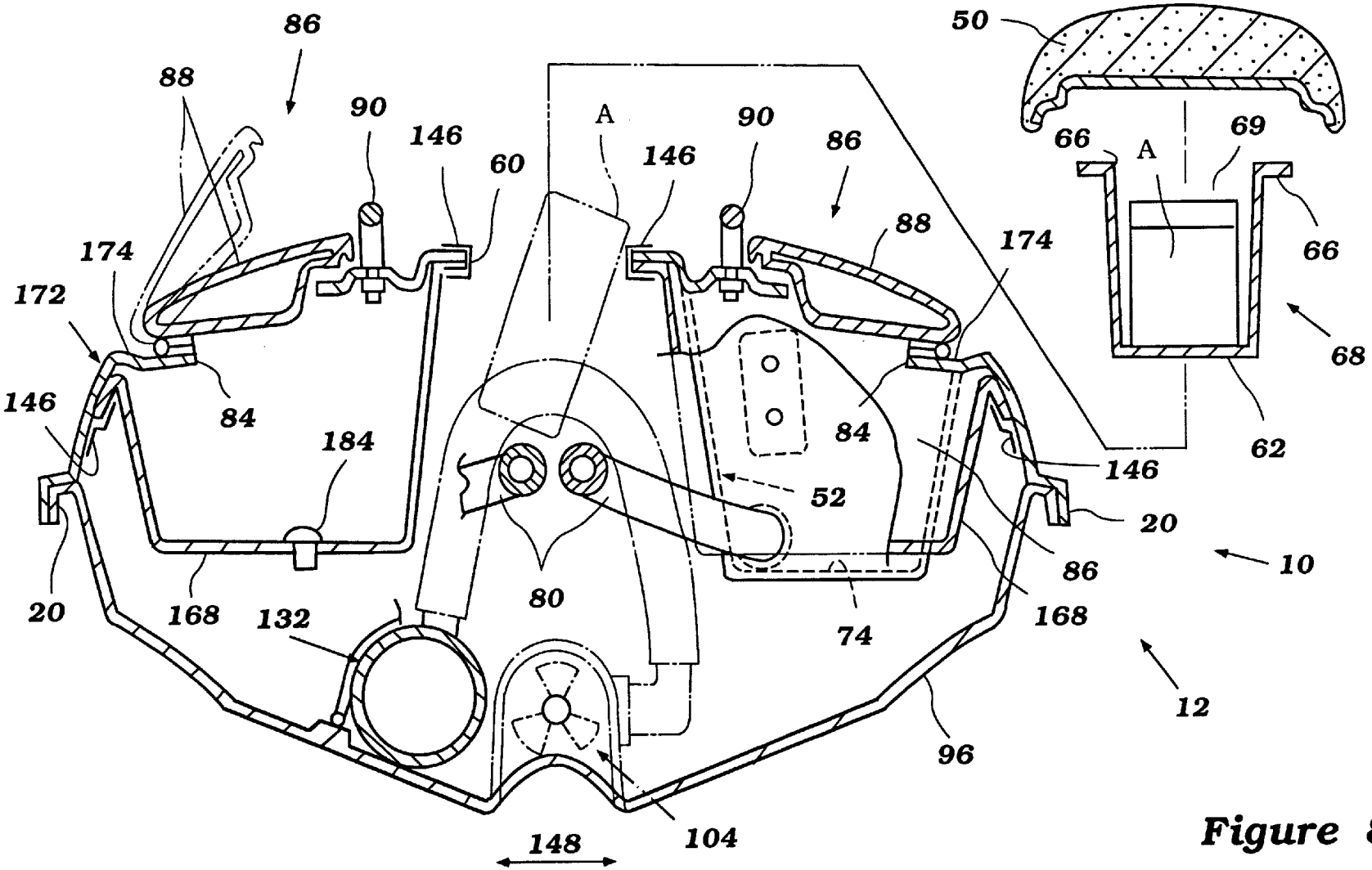
FIG. 8 is a cross-sectional view of the watercraft taken along line 7—7 of FIG. 3, illustrating the movement of the covers of the compartments shown in FIG. 7.

The expansion chamber in turn communicates with a water trap 132. At least a portion of the cooling water is introduced between the expansion chamber and the water trap for silencing purposes as known in the art. The water trap 132 inhibits the backflow of cooling water toward the expansion chamber 128. An exhaust pipe 130 connects the water trap 132 to a discharge opening. In the illustrated embodiment, as seen in FIGS. 3, 7 and 8, the exhaust pipe 130 extends over the tunnel and the jet propulsion unit 104 to further inhibit the influx of water into the exhaust system.

A fuel tank 134 is located in front of the engine 94 generally below the control portion of the upper deck section 18. A fuel guide tube 136 having an fuel inlet 138 at an end extends upwardly toward from the fuel tank 134. The fuel inlet 138 of the fuel guide 136 is fit to an opening formed bow portion of the upper deck section 18 of the watercraft 10. A cap 140 covers the fuel inlet 138 and the opening.

Figure 2:
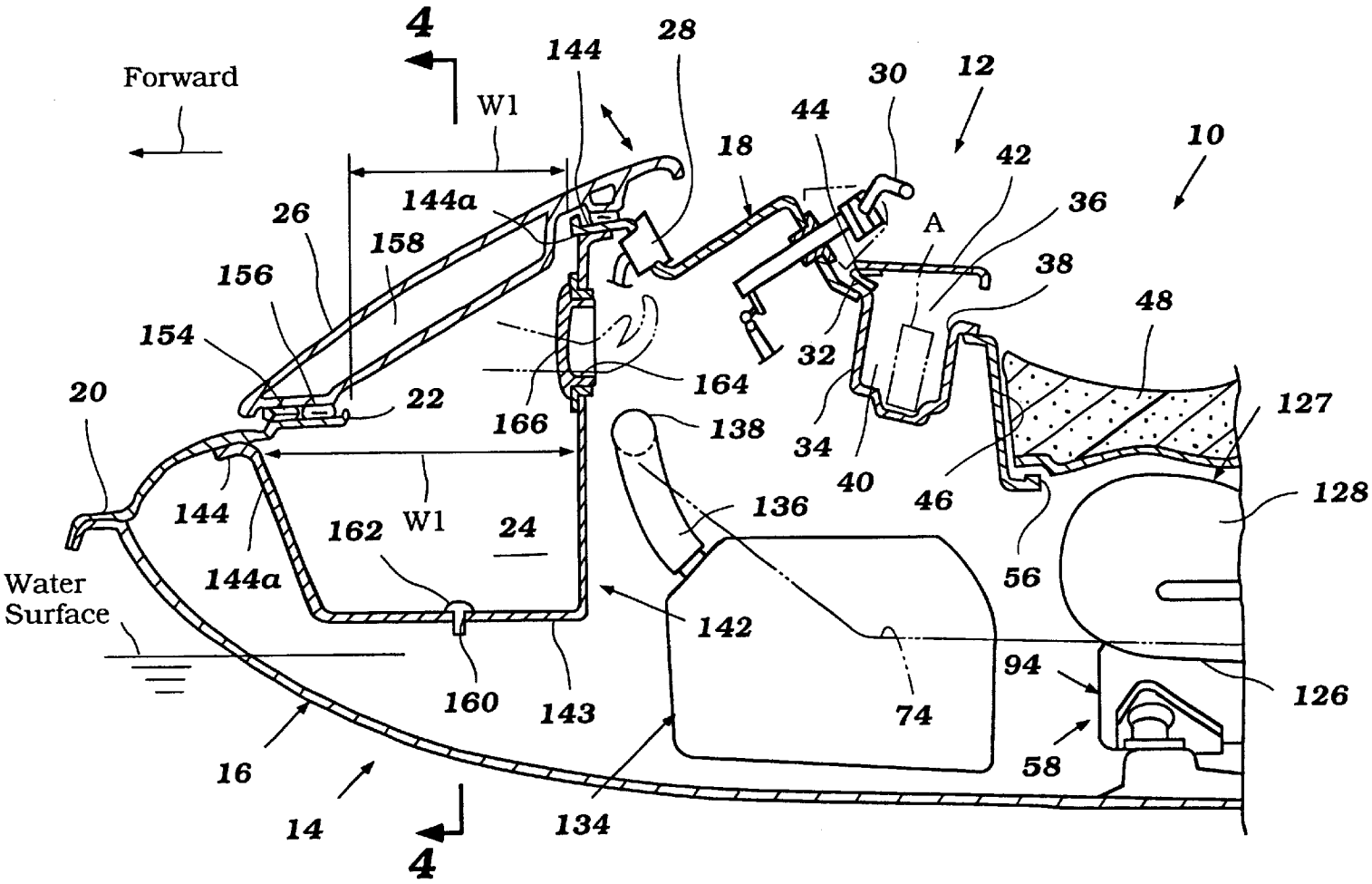
FIG. 2 is a partial side cross-sectional view of a front portion of the watercraft of FIG. 1.

With reference to FIGS. 1, 2 and 4, a container 142 is located under the opening 22 formed on the bow portion of the upper deck section 18. The container 142 has an open top defined by a circumferential flange 144 extending from walls of the container 142. The flange 144 defines an upper outer periphery of the container 142 and an upper inner perimeter edge 144*a*. Since the bow portion slopes upwardly toward the control portion, the walls of the container 142 may not have the same height. In the illustrated embodiment, the front wall is shorter than the rear wall and the side walls taper in height between the front and rear walls. The bottom surface 143 of the container 144 desirably is flat.

The flange 144 of the container 142 is attached to an interior wall of the upper deck section 18 surrounding the opening 22. A sealing sheet 146 (FIG. 4) is pressed over the interface between the flange 144 and the deck inner surface to provide watertight attachment. The container 142 and the sealing sheet 146 are advantageously made of the same material as the hull sections 14.

In the illustrated embodiment, as seen in FIG. 2, the container 142 is configured to have a width W1 of the open top in the longitudinal direction 124 larger than a width w1 of the opening 22 in the same direction. Further, as seen in FIG. 4, the container 142 has a width W2 of the open top in a lateral direction 148 larger than a width w2 of the opening 22 in the same direction. Advantageously, the width of the open top of the container 142 is larger than the width of the opening 22 on the bow portion of the upper deck section 18 in every horizontal direction.

A circumferential area 150 of the opening 22 is surrounded by the flange 144 of the container 142 by the attachment of the container 142 to the interior wall of the bow portion of the upper deck section 18. This circumferential area 150 and the container 142 in turn defines a space which is the front storage compartment 24. Advantageously, the container 142 is as large as the interior space within the hull 14, in which the container 142 is placed, allows. In this manner, the small watercraft 10 can has a larger storage compartment within the hull 14.

In the illustrated embodiment, the upper deck 18 has a upwardly protruded portion which includes the opening 22. The upwardly protruded portion 152 advantageously corresponds to the circumferential area 150 surrounded by the flange 144 of the container 142 as well illustrated in FIG. 4. This protruded portion 152 gives a larger space to the front storage compartment 24 and places the hatch 26 and opening 22 high up on the deck, away from the water surface of the body of water in which the watercraft is operated.

Partitions (not shown) may be placed within the storage compartment 24 to facilitate accommodation of small articles. The partitions can be vertical or horizontal. Advantageously, such partitions are removably located within the storage compartment 24.

The hatch 26 is configured to releasably cover the opening 22 on the bow portion of the upper deck section 18. Advantageously, a hinge 154 connects a lower end of the hatch 26 to the upper deck 18. In order to inhibit an influx of water into the front storage compartment 24, a seal member 156 is provided around either of the opening or a corresponding portion of the hatch 154.

The hatch 26 has an airtight hollow space 158. Because the hatch 26 is located in the top center portion of the watercraft 10 in the lateral direction 148 (i.e., located near the longitudinal axis of the watercraft), the hollow space 158 of the hatch 26 eases righting watercraft 10 when inverted. The hollow space 158 advantageously has the largest vertical thickness near the longitudinal axis of the watercraft.

As best seen in FIGS. 2 and 4, a drain opening 160 is provided on the bottom of the container 142 to drain water in case water comes into the container 142. A drain plug 162 closes the drain opening 160.

In the illustrated embodiment, an opening 164 is also formed on a wall of the container 142 to provide access into the interior space within the hull 14 for servicing components within the hull 14. For instance, the access opening 164 provides access to the instrument display 28 of the watercraft. A lid or cover 166 normally closes the opening 164. Advantageously, the opening 164 is on the rear wall of the container 142 which is closer to the control portion than the other walls. Thus, when servicing a components of the control portion, a hand can reach to the component through the opening 164, as shown in phantom in FIG. 2.

With reference now to FIGS. 1, 3, 5, 7, and 8, the upper deck section 18 includes two openings 84 near the aft end of the pedestal. A container 168 is placed under each of the openings 84. The pair of the opening 84 and container 168 are advantageously mirror images with each other. Therefore, the following description of one will be understood as applying to both, unless indicated otherwise.

The container 168 has an open top defined by a circumferential flange 170 that extends from walls of the container 168. Because the upper deck section 18 slopes upwardly from the gunnel 20 toward the center of the watercraft 10 in the lateral axis 148, the walls of the container 168 may not have the same height. That is, an outer side wall may be lower than an inner side wall, and the fore and aft walls taper in height between the inner and outer side walls.

The flange 170 of the container 168 is configured to be attached to the interior wall of the upper deck section 18 that surrounds the opening 84. The flange 170 of the container 168, which is attached to the side 172 of the upper deck 18, extends at an acute angle relative to the rear wall of the container 168. A sealing sheet 146 is pressed over the joint between the container 168 and the inner surface of the upper deck to provide a watertight attachment. The container 168 and the sealing sheet 146 are advantageously made of the same material as the hull sections.

In the illustrated embodiment, the container 168 is configured to have a width W3, as measured at its upper end in the longitudinal direction 124, which is larger than a width w3 of the opening 84 in the same direction. Further, the container 168 has a width W4, again measured at its upper end in a lateral direction 148, which is larger than a width w4 of the opening 84 in the same direction. Advantageously, the width of the upper opening of the container 168 is larger than the width of the opening 84 in every horizontal direction.

A circumferential area 114 of the opening is surrounded by the flange 170 of the container 168 when the container 168 is attached to the interior wall of the upper deck section 18. This circumferential area 174 and the container in turn define a space which comprises the rear storage compartment 86. Advantageously, the container 168 is as large as the hull interior space, in which the container 168 is placed, allows. In this manner, the small watercraft 10 can have a large rear storage compartment 86 within the hull.

The cover or lid 88, which closes the opening 84, is connected to the upper deck 18 by a hinge 176 near the side 172 of the watercraft 10 so that the passenger who is holding onto the bars 90 can easily open the lid 88 as illustrated in phantom in FIG. 7. In order to inhibit an influx of water into the rear storage compartment 86, a seal member 178 is provided around either of the opening 84 or a corresponding portion of the lid 88. The lid 88 also has an airtight hollow space 180 similar to the hatch 26 described above. Advantageously, the vertical thickness of the hollow space 180 gets larger toward the center portion of the watercraft 10 in the lateral direction 148 so that the watercraft 10 can righted easier when inverted.

A drain opening 182 is provided on the bottom of the container 168 to drain water in case water comes into the container 168. A drain plug 184 closes the drain opening 182. In the illustrated embodiment, the storage compartment 68, which is located beneath the rear seat cushion 50, is arranged between the two rear storage compartments 86 and stores relatively small articles.

Figure 9:
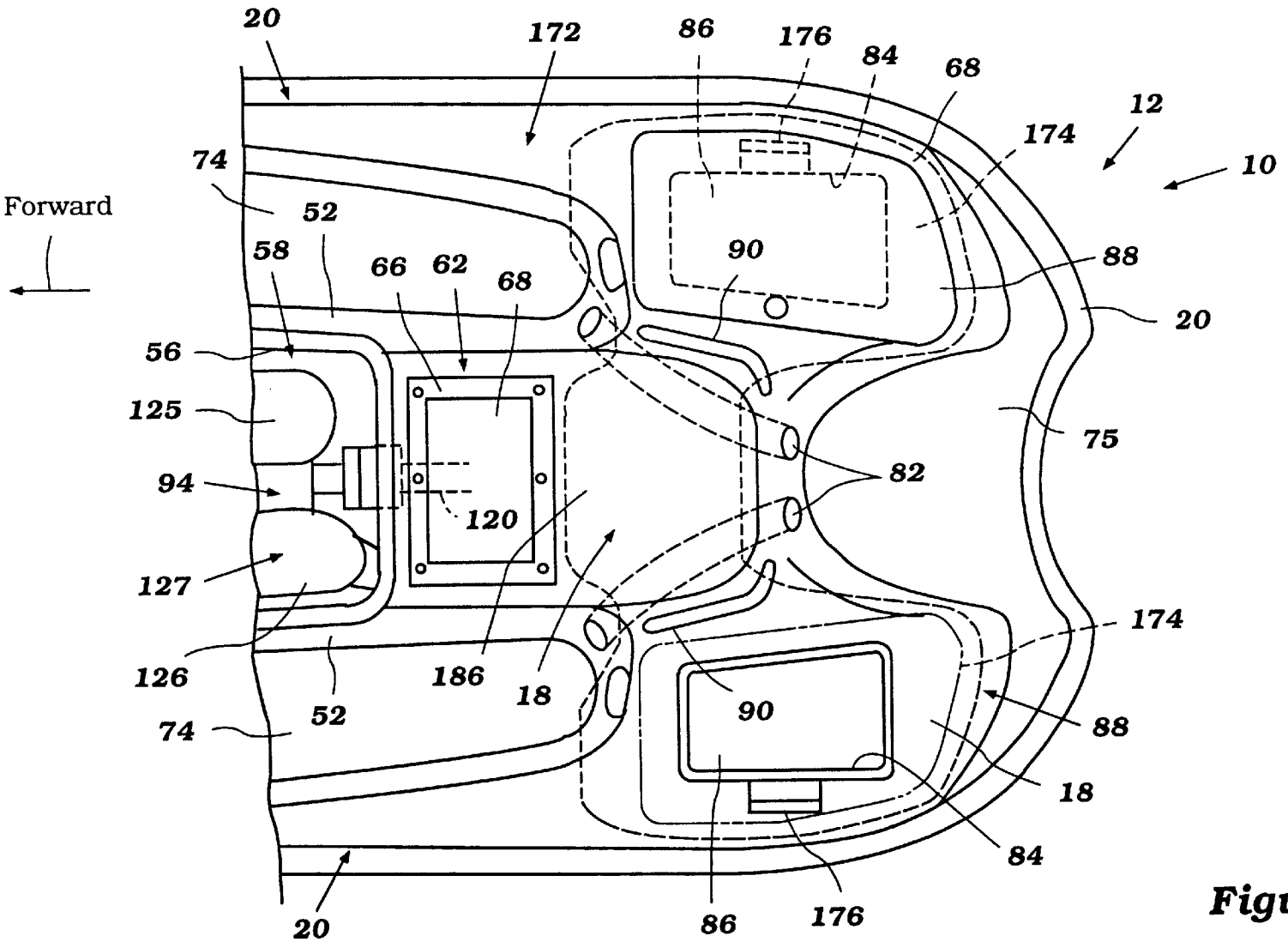
FIG. 9 is a top plan view of the rear portion of a watercraft, illustrating another embodiment of the rear storage compartment.
Figure 10:
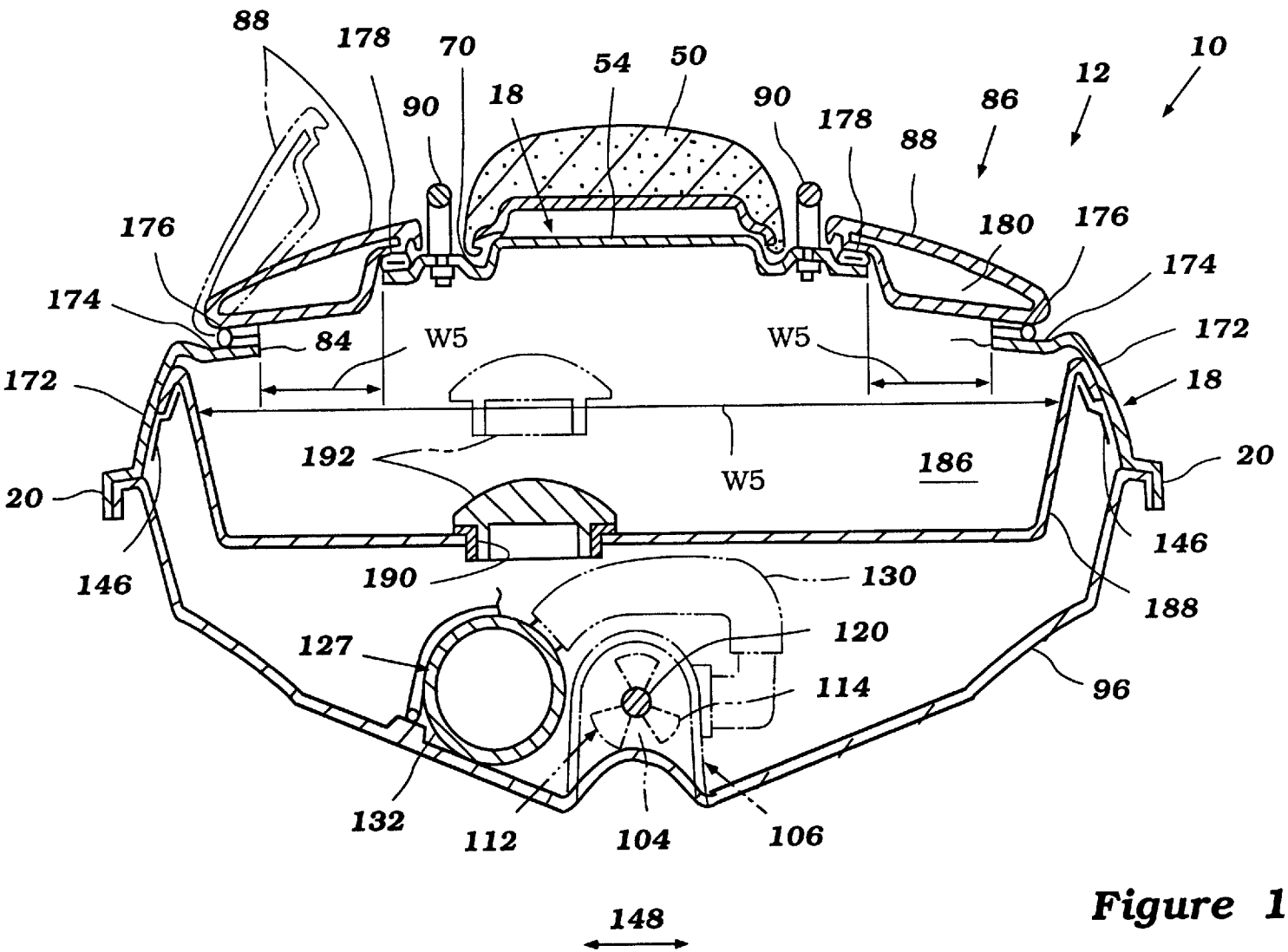
FIG. 10 is a cross-sectional view of the watercraft of FIG. 9, corresponding to the view illustrated in FIG. 7 of the embodiment of FIGS. 1–8.

FIGS. 9 and 10 illustrate another structure and arrangement of a rear storage compartment 186 in accordance with another embodiment of the present watercraft hull design.

The front half of the watercraft desirably is configured in accordance with the foregoing description. In this embodiment, a single storage compartment 186 is defined rather than two, as in the above-described embodiment. The two openings 84 therefore open into a single large container 188 that defies the rear storage compartment 186. The container 188 is attached to the inner surface of the upper deck in the manner described above.

Advantageously, a width W5 of the container in the lateral direction 148 is substantially same as the width of the upper deck section 18 of the watercraft 10 while the width w4 of the two openings 84 remain the same as the above embodiment. Thus, the width of the container is substantially wider than the width of either opening 84, and, in the illustrated embodiment, is wider than the combined widths of the openings 84. The large container 188 may not allow the tall and narrow arch of the second exhaust tube 130 as illustrated in phantom in FIG. 7, and thus the second exhaust tube 130 may be located under the container 188 in the manner as shown in phantom in FIG. 10. That is, the exhaust pipe 130 extends from an upper side of the water trap 132, passes over the top of the tunnel, and then depends downward on the opposite side of the tunnel where it terminates at the discharge end of the exhaust system.

In the illustrated embodiment, the bottom of the container includes a relatively large drain opening 190 which is closed by a drain plug 192. The relatively large drain opening 190 is arranged to be used as an access to the jet pump unit 104 for servicing.

FIGS. 11–16 illustrates a personal watercraft 10 having several storage compartments in accordance with an additional preferred embodiment of the watercraft design. Like elements are referred by like numerals, and the foregoing description of like components between the two embodiments should be understood to apply to the present embodiment unless indicated otherwise.

Figure 11:
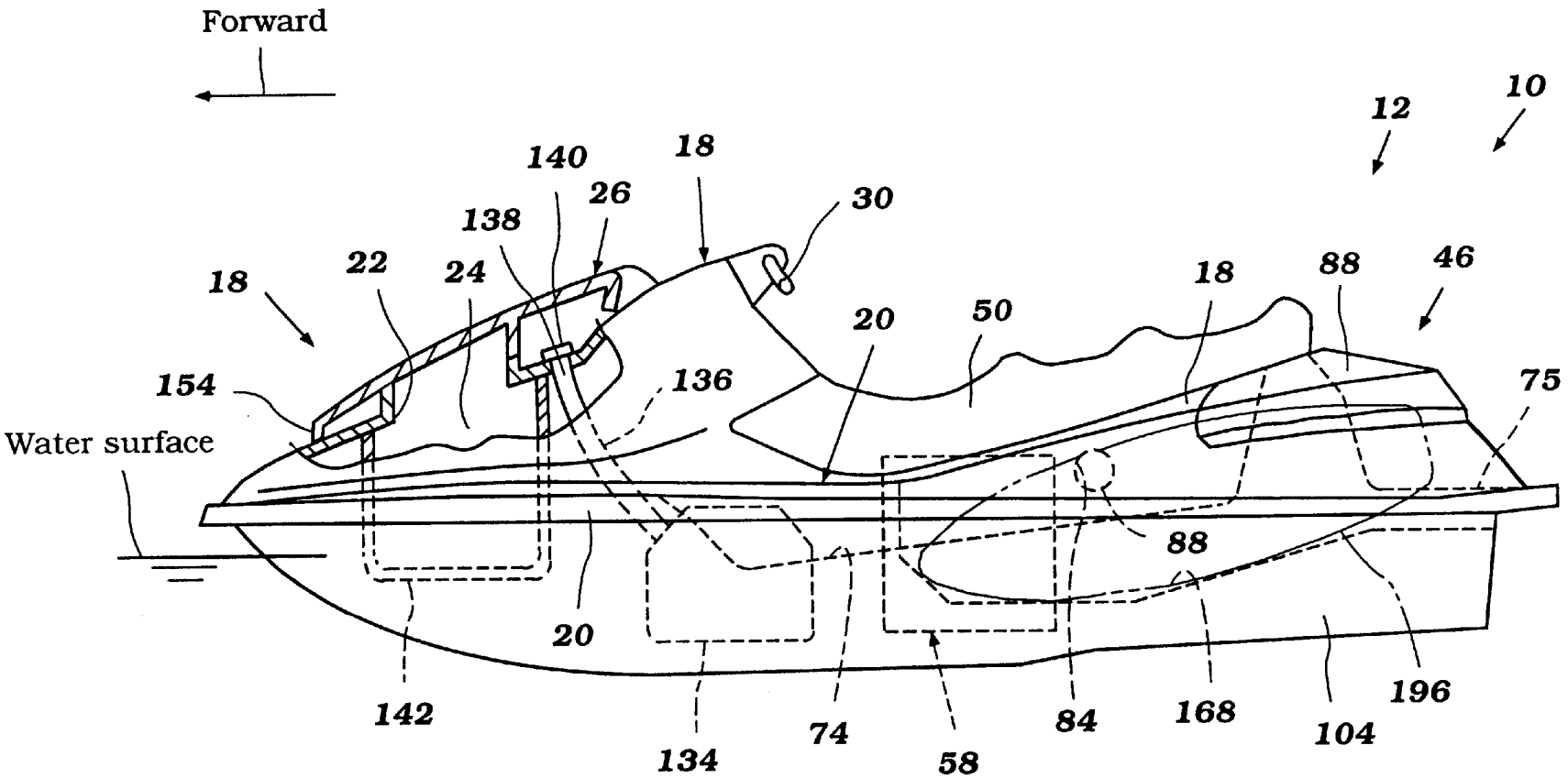
FIG. 11 is a side view of a watercraft configured in accordance with another embodiment of the present invention, illustrating several inner component in phantom.
Figure 12:
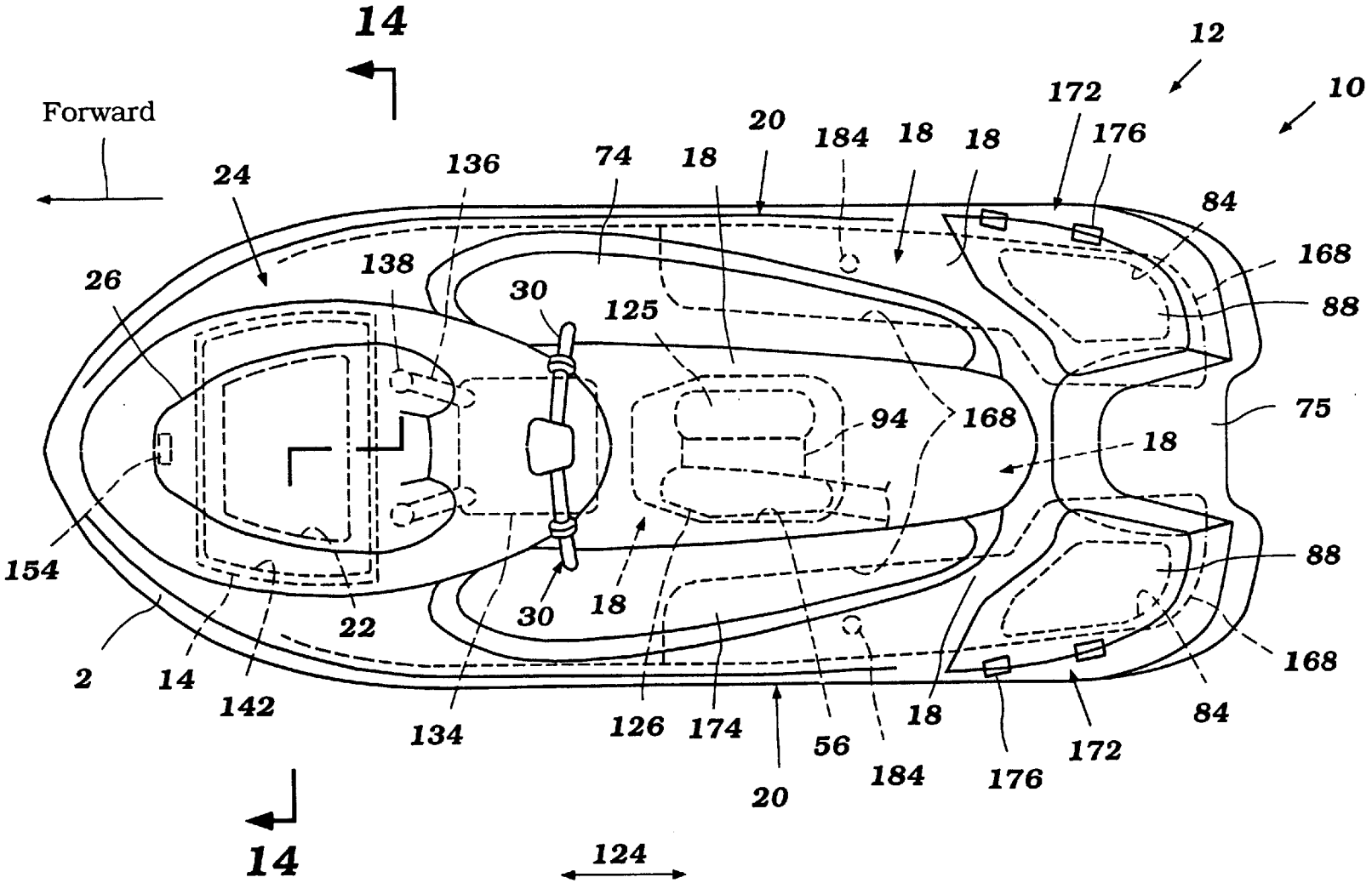
FIG. 12 is a top plan view of the watercraft of FIG. 11, illustrating several inner component in phantom.
Figure 13:
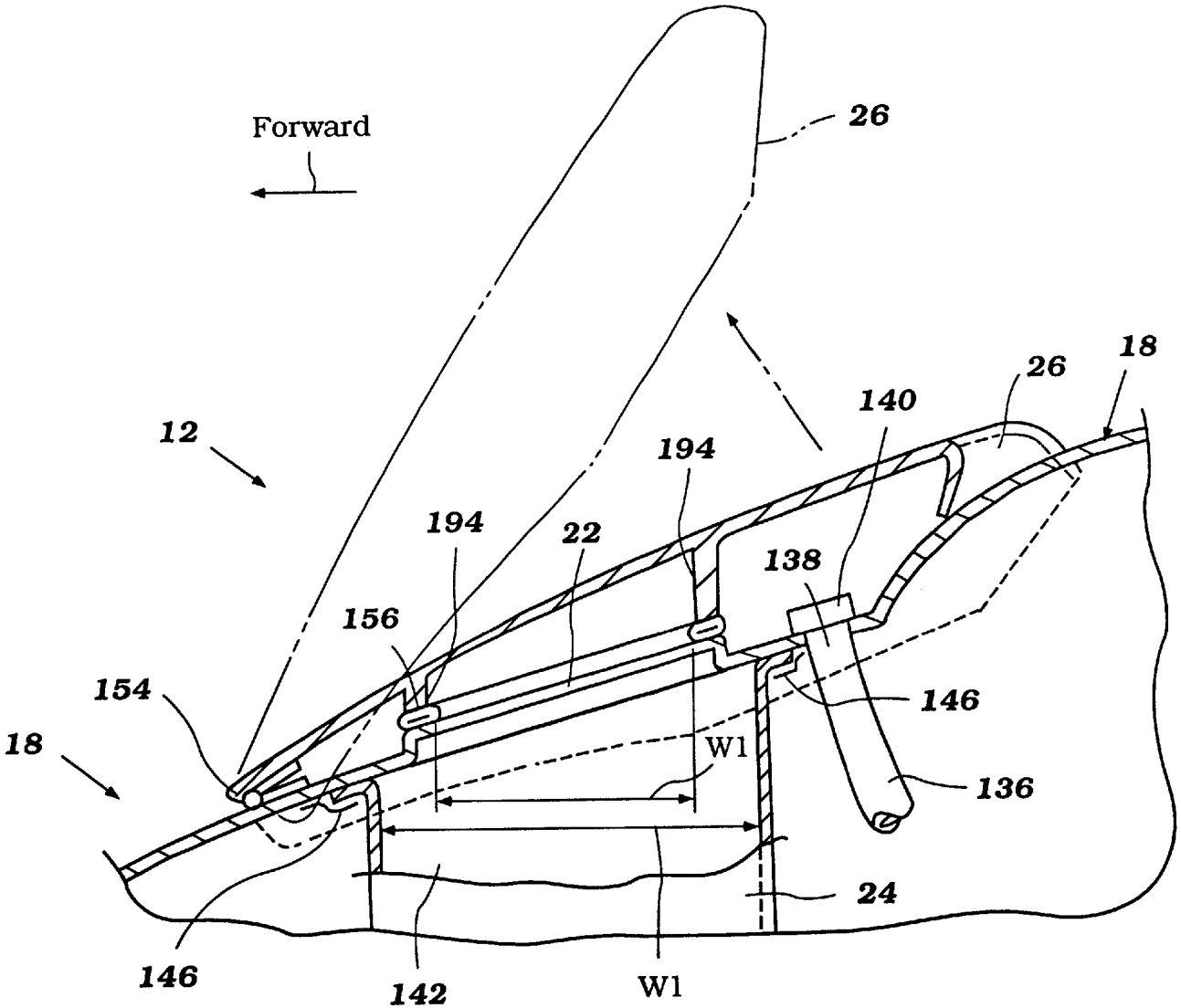
FIG. 13 is a sectional view of a hatch of the watercraft of FIG. 11, illustrating an open state of the hatch in phantom.

With reference to FIGS. 11, 12, and 13, an opening 22 is formed on the bow portion of the upper deck section 18. A container 142 having an open top is attached to an interior surface of the upper deck section 18, which surrounds the opening 22, to define a front storage compartment 24.

The container 142 is configured to have a width W1, as measured at its upper end and in the longitudinal direction 124, which is larger than a width w1 of the opening 22 in the same direction. Further, the container 142 has a width W2 at its upper end as measured in a lateral direction 148 which is larger than a width w2 of the opening 22 in the same direction. Advantageously, the width of the open top of the container 142 is larger than the width of the opening 22 on the bow portion of the upper deck section 18 in every horizontal direction.

A hatch 26 is mounted on the upper deck section 18 to releasably close the opening 22. A hinge 154 connects a lower end of the hatch 26 to the upper deck section 18. In the illustrated embodiment, the hatch 26 is much longer than the width w1 of the opening 22 in the longitudinal direction and covers a significant portion of the bow of the upper deck section 18. In FIG. 13, an open state of the hatch 26 is illustrated in phantom.

Figure 14:
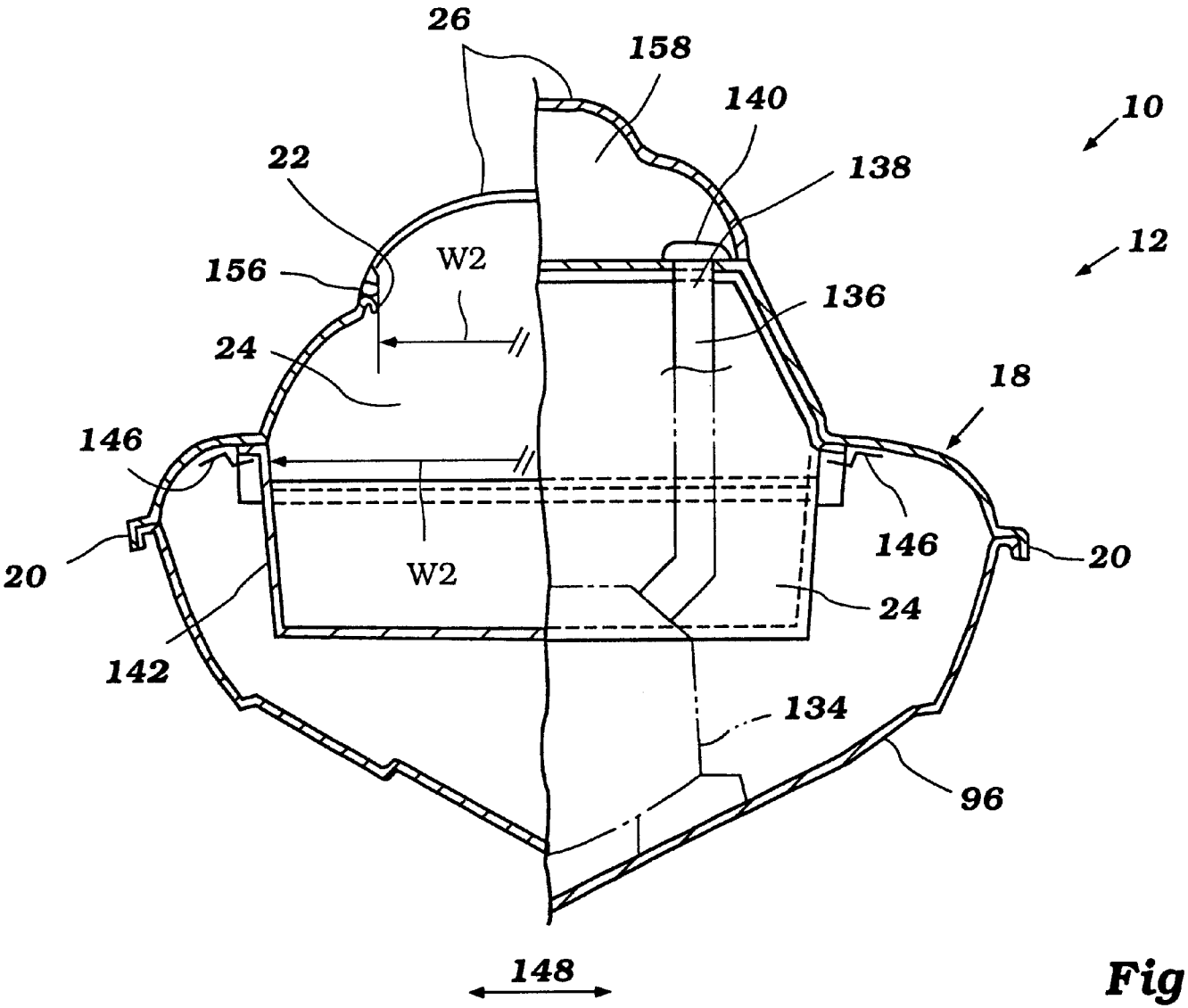
FIG. 14 is a cross-sectional view of the watercraft taken along line 14—14 in FIG. 12.

A rib 194 protrudes from a lower surface of the hatch 26 to contact a circumference of the opening 22. A seal member 156 is provided on either of the circumference of the opening or a distal portion of the rib 194 of the hatch 26 to inhibit an influx of water into the front storage compartment 24. As illustrated in FIGS. 12, 13, and 14, the hatch 26 also covers the fuel inlet 138 of the fuel guide 136. The hatch 26 also defines a closed space filled with air as described in the above embodiment With reference to FIGS. 11, 12, 15, and 16, two openings 84 are provided at both sides of the riding floor 74 on the upper deck section 18. A container 168 is located under each opening 84. The pair of the opening 84 and the containers 168 are advantageously mirror images with each other. The following description of one therefore applies equally to both, unless indicated otherwise.

The container 168 has an open top defined by a circumferential flange 170 that extends from walls of the container 168. Some portion of the container flange 170 is configured to be attached to the interior wall of the upper deck section 18. The other portion of the container flange 170 is configured to be attached to the lower hull and upper deck sections 16, 18 at the gunnel 20, which makes the attachment of the container 168 strong and further the strength of the corresponding gunnel 20. A sealing sheet 146 overlies the joint to provide watertight attachment. The container 168 and the sealing sheet 146 are advantageously made of the same material as the hull sections 16, 18.

Figure 15:
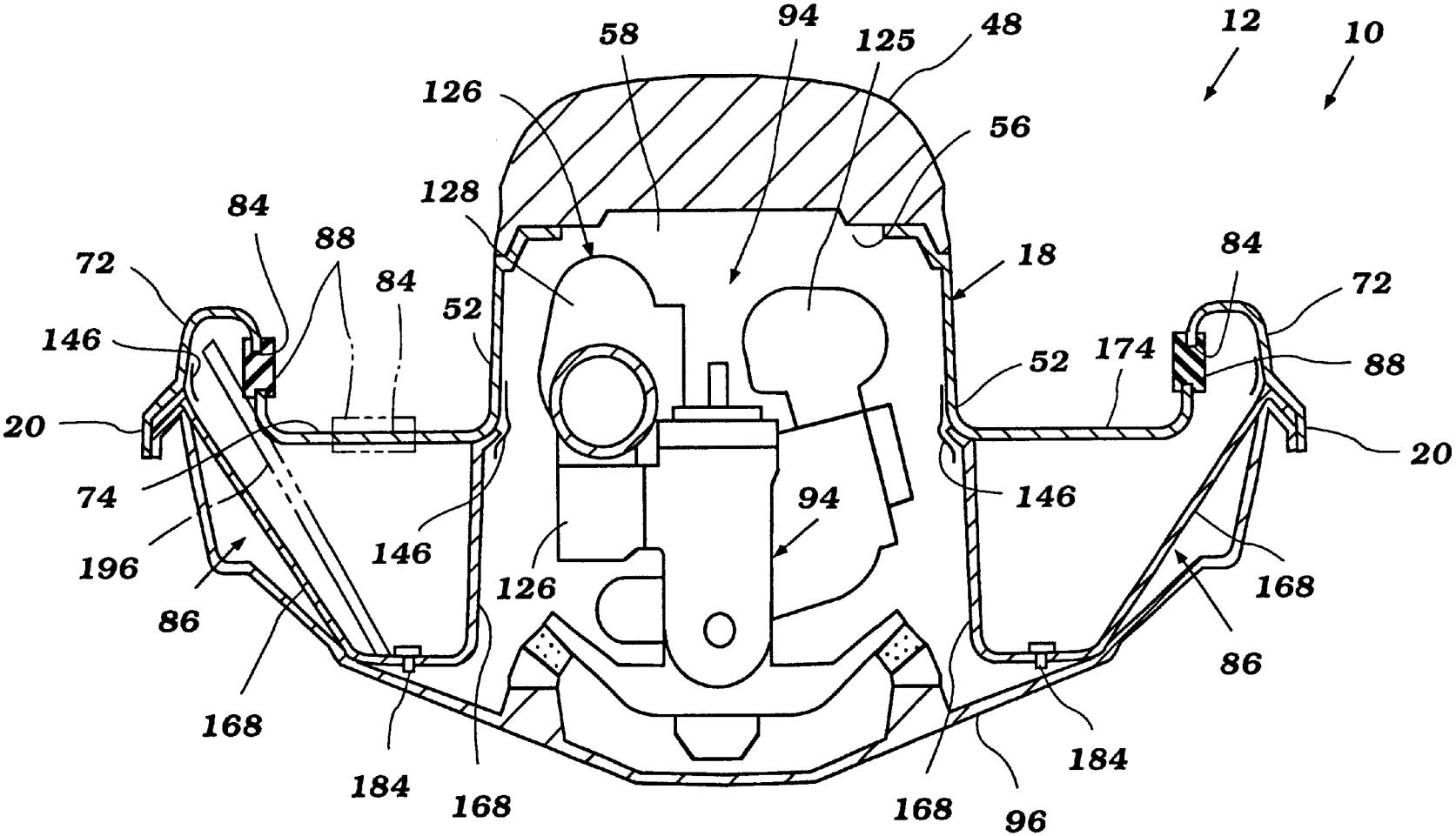
FIG. 15 is a cross-sectional view of the watercraft of FIG. 11, corresponding to FIG. 6 of the embodiment of FIGS. 1–8.
Figure 16:
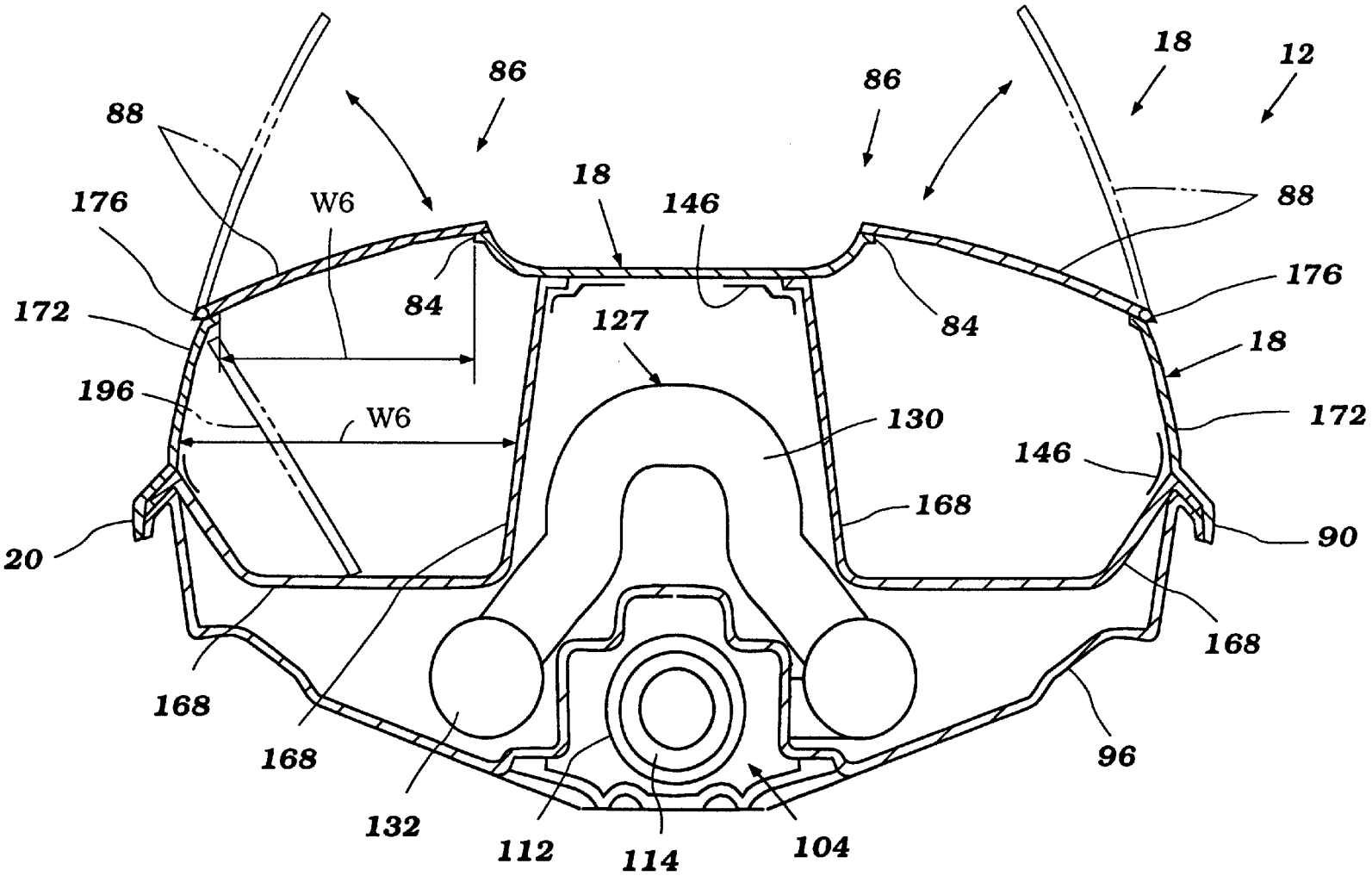
FIG. 16 is a cross-sectional view of the watercraft of FIG. 11, corresponding to FIG. 7 of the embodiment of FIGS. 1–8.

A circumferential area of the opening 84 is surrounded by the flange 170 of the container 168. The circumferential area the container 168 define a rear storage compartment 86. As some portion of the container flange 170 forms gunnel 20, the interior space of the bulwark 72 also constitutes a part of the rear storage compartment 86 as illustrated in FIG. 15. Further, the container 168 extends to the interior space of the hull 14 under the foot steps 74 along the longitudinal axis 124 to provide a larger rear storage compartment 86 within the hull 14 as illustrated in FIG. 15. By using these spaces, the rear storage compartment 86 may accommodate relatively long articles, such as, for example, a water ski 196, fishing equipment, etc.

A width W6 of the open top of the container 168 in the longitudinal direction 124 is much larger than a width w6 of the opening 84 in the same direction. Further, a width W7 of the container's open top in a lateral direction 148 larger than a width w7 of the opening 84 in the same direction. Advantageously, the width of the open top of the container 168 is larger than the width of the opening 84 in every horizontal direction.

The cover or lid 88, which closes the opening 84, is connected to the upper deck 18 by a hinge 176 near the side 172 of the watercraft 10. A seal member 178 may be provided around either of the opening 84 or a corresponding portion of the lid 88. Advantageously, the cover 88 slopes upwardly toward the center of the watercraft 10 in the lateral axis 148 so that the watercraft 10 can easily recover even when it is turned over.

As common to the embodiments described above, the storage compartments within the hull of the watercraft are arranged in a manner maximizing storage capacity while maintaining or enhancing the structural strength of the watercraft body. The arrangement and structure of the storage compartments also helps right the watercraft when inverted.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A small watercraft comprising a hull including a lower hull portion and an upper deck, the upper deck including a bow portion and a rider's area position on an aft side of the bow portion, a raised pedestal provided on the hull in the rider's area, a seat assembly supported by the raised pedestal and including a seat configured to accommodate at least one rider, a container affixed to the upper deck and having an upper inner perimeter edge, an access opening formed in the upper deck and opening into the container, said opening having a smaller area than the area defined by the upper inner perimeter edge of the container, and a hatch movably coupled to the upper deck so as to be moved between a closed position, in which the hatch covers the opening, and an open position, in which the hatch permits access into the container through the opening.

2. A small watercraft as in claim 1, wherein the container, the access opening and the hatch are located on the bow portion of the upper deck.

3. A small watercraft as in claim 1, wherein the container, the access opening and the hatch are located in the rider's area.

4. A small watercraft as in claim 3, wherein the container, the access opening and the hatch are located at a stern portion of the watercraft hull.

5. A small watercraft as in claim 1, wherein the container is affixed to the upper deck about its perimeter edge.

6. A small watercraft as in claim 1 additionally comprising a hinge coupling which pivotally attaches the hatch to the upper deck.

7. A small watercraft as in claim 1, wherein the hull has a longitudinal axis that extends from bow to stern, and a longitudinal dimension of the access opening is smaller than a longitudinal dimension of the container as measured across the upper inner perimeter edge.

8. A small watercraft as in claim 1, wherein the hull has a longitudinal axis that extends from bow to stern, and a lateral dimension of the access opening, which is measured generally normal to the longitudinal axis in a plane in which the access opening is generally formed, is smaller than a lateral dimension of the container, as measured across the upper inner perimeter edge in a direction generally normal to the longitudinal axis.

9. A small watercraft as in claim 1 additionally comprising a sealing member operating between the upper deck and the hatch about the circumference of the access opening.

10. A small watercraft as in claim 1, wherein the hatch includes a generally sealed inner space.

11. A small watercraft as in claim 10, wherein the hatch includes an upper section and a lower section and side sections, and a distance between the upper and lower sections is greater near a longitudinal axis of the watercraft than near the side sections of the hatch.

12. A small watercraft as in claim 1, wherein the container includes an opening through a wall of the container to provide access into a space beneath the upper deck.

13. A small watercraft as in claim 12 additionally comprising an instrument display located forward of the rider's area, and the opening in the container is located to open into a space defined below the instrument display.

14. A small watercraft as in claim 1, wherein the container includes a drain hole.

15. A small watercraft as in claim 1, wherein the container is affixed to an interior surface of the upper deck.

16. A small watercraft as in claim 1, wherein at least two walls of the container have different heights.

17. A small watercraft as in claim 16, wherein the section of the upper deck to which the container is affixed includes a fore portion and an aft portion, the fore and aft portions are at different elevational levels relative to the lower hull section, and the container lies generally between the fore and aft portions.

18. A small watercraft as in claim 1 additionally comprising a second container affixed to the upper deck, and the deck including a second access opening which opens into the container.

19. A small watercraft as in claim 1, wherein the container and hatch together define a enclosed compartment with the hatch in the closed position, and an aft end of the compartment is taller than a fore end of the compartment.

20. A small watercraft as in claim 1, wherein the container is affixed to the upper deck by an adhesive.

21. A small watercraft comprising a hull including a lower hull portion and an upper deck, an inner hull space being defined between the lower hull portion and the upper deck, at least part of the inner hull space defining an engine compartment, the upper deck including a bow portion and a rider's area position on an aft side of the bow portion, a raised pedestal provided on the hull in the rider's area, a seat assembly supported by the raised pedestal and including a seat configured to accommodate at least one rider, a pair of raised bulwarks extending along opposite sides of at least a portion of the raised pedestal, a pair of foot surfaces, each surface extending between the raised pedestal and one of the raised bulwarks such that foot step areas are defined on the opposite sides of the raised pedestal, and a storage compartment defined within the inner hull space and separated from the engine compartment, at least part of the storage compartment extending into one of the raised bulwark above the corresponding foot surface.

22. A small watercraft as in claim 21, wherein at least part of the storage compartment extends beneath the corresponding foot surface.

23. A small watercraft as in claim 21 additionally comprising a second storage compartment extending into the other raised bulwark above the corresponding foot surface.

24. A small watercraft as in claim 21 additionally comprising an access opening into the storage compartment, and a hatch covering the access opening, the hatch being hinged on a side that is generally opposite a longitudinal center line of the watercraft.

25. A small watercraft as in claim 24, wherein the access opening is disposed near an aft end of the watercraft.

26. A small watercraft as in claim 25, wherein the access opening is disposed to one side of an aft end of the seat assembly.

27. A small watercraft as in claim 25 additionally comprising a deck area located at a stern of the watercraft, and the access opening being disposed near the deck area.

28. A small watercraft as in claim 21 additionally comprising a drain communicating with the foot step area, the drain discharging through at least one discharge port that is disposed at a point near an aft end of the watercraft and proximate to a longitudinal centerline of the watercraft.

29. A small watercraft as in claim 28 additionally comprising a deck area being disposed at a stern of the watercraft, and the discharge port is arranged above the deck area.

30. A small watercraft as in claim 28 additionally comprising a jet propulsion device being disposed at an aft end of the watercraft and being generally centered relative to the longitudinal centerline of the watercraft.

31. A small watercraft as in claim 28, wherein the drain includes a drain hole in the foot step area, and the drain hole is arranged lower than the discharge port when a keel line of the watercraft is generally level.

32. A small watercraft as in claim 21, wherein at least a portion of the storage compartment is formed by a container affixed to the upper deck.

33. A small watercraft as in claim 32 additionally comprising an access opening formed in the upper deck and opening into the container, the container having an upper inner perimeter edge, and the access opening having, a smaller area than an area defined by the upper inner perimeter edge of the container.

34. A watercraft as in claim 33 additionally comprising a hatch coupled to the upper deck by a hinge and being movable between an open position and a closed position, the hatch covering the access opening when in the closed position, and the hinge being disposed on a side of the hatch that is farthest from a longitudinal centerline of the watercraft.

35. A small watercraft as in claim 32, wherein at least a portion of the container walls the storage compartment from the engine compartment.

36. A small watercraft comprising a hull including a lower hull portion and an upper deck, an inner hull space defined between the lower hull portion and the upper deck, at least part of the inner hull space defining an engine compartment, the upper deck including a bow portion and a rider's area position on an aft side of the bow portion, a raised pedestal provided on the hull in the rider's area, a seat assembly supported by the raised pedestal and including a seat configured to accommodate at least one rider, a pair of raised bulwarks extending along opposite sides of at least a portion of the raised pedestal, a pair of foot surfaces, each surface extending between the raised pedestal and one of the raised bulwarks such that foot step areas are defined on the opposite sides of the raised pedestal, and a storage compartment defined within the inner hull space apart from the engine compartment, the storage compartment having an opening disposed at least partially rearward from the seat assembly, at least part of the storage compartment extending from an aft location within the inner hull space into a portion of the inner hull space which lies beneath one of the foot surfaces.

37. A small watercraft as in claim 36, additionally comprising a second storage compartment extending beneath the other foot surface.

38. A small watercraft as in claim 37, wherein each storage compartment extends into the corresponding raised bulwark above the respective foot surface.

39. A small watercraft as in claim 36 additionally comprising a hatch covering the opening, the hatch being hinged on a side that is generally opposite a longitudinal center line of the watercraft.

40. A small watercraft as in claim 39, wherein the opening is disposed near an aft end of the watercraft.

41. A small watercraft as in claim 40, wherein the opening is disposed to one side of an aft end of the seat assembly.

42. A small watercraft as in claim 40 additionally comprising a deck area located at a stern of the watercraft, the opening being disposed near the deck area.

43. A small watercraft as in claim 36 additionally comprising a drain communicating with the foot step area, the drain discharging through at least one discharge port that is disposed at a point near an aft end of the watercraft and proximate to a longitudinal centerline of the watercraft.

44. A small watercraft as in claim 36, wherein at least a portion of the storage compartment is formed by a container affixed to the upper deck.

45. A small watercraft as in claim 44 wherein the opening is formed in the upper deck and opens into the container, the container having an upper inner perimeter edge, the opening having a smaller area than an area defined by the upper inner perimeter edge of the container.

46. A watercraft as in claim 45 additionally comprising a hatch coupled to the upper deck by a hinge and being movable between an open position and a closed position, the hatch covering the opening when in the closed position, and the hinge being disposed on a side of the hatch that is farthest from a longitudinal centerline of the watercraft.

47. A small watercraft as in claim 44, wherein the container comprises at least one wall that blocks the storage compartment from the engine compartment.

48. A small watercraft comprising a hull including a lower hull portion and an upper deck, an inner hull space defined between the lower hull portion and the upper deck, at least part of the inner hull space defining an engine compartment, the upper deck including a bow portion and a rider's area position on an aft side of the bow portion, a raised pedestal provided on the hull in the rider's area, a seat assembly supported by the raised pedestal and including a scat configured to accommodate at least one rider, a pair of raised bulwarks extending along opposite sides of at least a portion of the raised pedestal, a pair of foot surfaces, each surface extending between the raised pedestal and one of the raised bulwarks, and a pair of aft walls, each aft wall extending up from a corresponding foot surface and between the raised pedestal and a corresponding one of the raised bulwarks such that foot step areas arc defined on the opposite sides of the raised pedestal forward of the aft walls, and a pair of storage compartments defined within the inner hull space and separated from the engine compartment, each of the storage compartments having an opening disposed at least partially rearward from the aft walls, at least part of each storage compartment extending forward of one of the aft walls.

49. A small watercraft comprising a hull including a lower hull portion and an upper deck, an inner hull space defined between the lower hull portion and the upper deck, at least part of the inner hull space defining an engine compartment, the upper deck including a bow portion and a rider's area position on an aft side of the bow portion, a raised pedestal provided on the hull in the rider's area, a seat assembly supported by the raised pedestal and including a seat configured to accommodate at least one rider, a pair of raised bulwarks extending along opposite sides of at least a portion of the raised pedestal, a pair of foot surfaces, each surface extending between the raised pedestal and one of the raised bulwarks, and a pair of aft walls, each aft wall extending up from a corresponding foot surface and between the raised pedestal and a corresponding one of the raised bulwarks such that foot step areas are defined on the opposite sides of the raised pedestal forward of the aft walls, and a pair of storage compartments defined within the inner hull space and separated from the engine compartment, at least part of each storage compartment extending forward of one of the aft walls, wherein at least one of the storage compartments extends into one of the raised bulwark above the corresponding foot surface.

50. A small watercraft as in claim 49, wherein at least part of the storage compartment extends beneath the corresponding foot surface.

51. A small watercraft as in claim 48, wherein at least one of the storage compartments extends beneath a corresponding one of the foot surfaces.

52. A small watercraft as in claim 48, wherein the opening is disposed above a portion of at least one of the storage compartments, and a hatch covering the opening, the hatch being hinged on a side that is generally opposite a longitudinal center line of the watercraft.

53. A small watercraft as in claim 52 additionally comprising another opening disposed above a portion of the other storage compartment, and another hatch covering the other opening, the hatch being hinged on a side that is generally opposite a longitudinal center line of the watercraft.

54. A small watercraft as in claim 53, wherein the openings are disposed near an aft end of the watercraft.

55. A small watercraft as in claim 54, wherein the openings are disposed on opposite sides of an aft end of the seat assembly.

56. A small watercraft as in claim 48 additionally comprising a drain communicating with at least one of the foot step areas, the drain including a drain hole disposed on a corresponding aft wall and discharging through at least one discharge port that is disposed at a point near an aft end of the watercraft and proximate to a longitudinal centerline of the watercraft.

57. A small watercraft as in claim 56, wherein the drain includes a drain hole in the foot step area, and the drain hole is arranged lower than the discharge port when a keel line of the watercraft is generally level.

58. A small watercraft as in claim 48, wherein at least a portion of at least one of the storage compartments is formed by a container affixed to the upper deck.

59. A small watercraft as in claim 58, wherein the opening is formed in the upper deck and opens into the container, the container having an upper inner perimeter edge, the opening having a smaller area than an area defined by the upper inner perimeter edge of the container.

60. A watercraft as in claim 59 additionally comprising a hatch coupled to the upper deck by a hinge and being movable between an open position and a closed position, the hatch covering the opening when in the closed position, and the hinge being disposed on a side of the hatch that is farthest from a longitudinal centerline of the watercraft.

61. A small watercraft as in claim 58, wherein the container comprises at least one wall that blocks the storage compartment from the engine compartment.

62. A small watercraft comprising a hull including a lower hull portion and an upper deck, the upper deck including a bow portion and a rider's area positioned on an aft side of the bow portion, a raised pedestal provided on the hull in the rider's area, a seat assembly supported by the raised pedestal and including a seat configured to accommodate at least one rider, a pair of raised bulwarks extending along opposite sides of at least a portion of the raised pedestal, a pair of foot surfaces, each surface extending between the raised pedestal and one of the raised bulwarks such that foot step areas are defined on the opposite sides of the raised pedestal, a storage compartment disposed between the lower hull portion and the upper deck, an access opening into the storage compartment and being disposed near an aft end of the watercraft, and a hatch covering the access opening, the hatch being hinged on a side that is generally opposite a longitudinal center line of the watercraft, the hatch being positioned such that the hatch is not completely defined as part of one of the foot surfaces.

63. A small watercraft as in claim 62, wherein the hull portion and the upper deck together define an inner hull space within the hull, at least part of the inner hull space defines the engine compartment, and another part of the inner hull space defines the storage compartment.

64. A small watercraft as in claim 63, wherein the storage compartment is separated from the engine compartment.

65. A small watercraft as in claim 63, wherein at least part of the storage compartment extends into one of the raised bulwarks above the corresponding foot surface.

66. A small watercraft as in claim 63, wherein at least part of the storage compartment extends beneath the one of the foot surfaces.

67. A small watercraft as in claim 63, wherein the access opening is disposed near an aft end of the watercraft.

68. A small watercraft as in claim 67, wherein the access opening is disposed to one side of an art end of the seat assembly.

69. A small watercraft as in claim 67, wherein the upper deck includes a deck platform located at a stern of the watercraft, and the access opening is disposed near the deck platform.

70. A small watercraft as in claim 63 additionally comprising a drain communicating with one of the foot step areas, the drain terminating through at least one discharge port that is disposed at a point near an aft end of the watercraft and proximate to the longitudinal center line of the watercraft.

71. A small watercraft as in claim 70, wherein the upper deck includes a deck platform located at a stern of the watercraft, and the drain discharge port is arranged above the deck platform.

72. A small watercraft as in claim 63 additionally comprising another storage compartment defined within the inner hull space and separated from the engine compartment and the other storage compartment, another access opening that opens into the another storage compartment and being disposed near an aft end of the watercraft, and another hatch covering the another access opening, the hatch being hinged on a side that is generally opposite the longitudinal center line of the watercraft.

73. A small watercraft as in claim 72, wherein the storage compartments are disposed within the inner hull space on opposite sides of the longitudinal center line.

74. A small watercraft as in claim 73 additionally comprising a pair of aft walls, each aft wall extending up from a corresponding foot surface and between the raised pedestal and a corresponding one of the raised bulwarks such that the foot step areas are defined on the opposite sides of the raised pedestal forward of the aft walls, and at least part of each storage compartment extending forward of one of the aft walls.

75. A small watercraft as in claim 72 additionally comprising a bow storage compartment disposed near the bow of the watercraft, the upper deck including an access opening into the bow storage compartment, the bow storage compartment being defined at least in part by a container affixed to the upper deck beneath the access opening and having an upper inner perimeter edge, the access opening having a smaller area than the area defined by the upper inner perimeter edge of the container, and a bow hatch movably coupled to the upper deck so as to be moved between a closed position, in which the bow hatch covers the access opening, and an open position, in which the bow hatch permits access into the bow storage compartment through the access opening.

* * * * *